United States Patent [19]

DeMarco

[11] Patent Number: 4,674,524

[45] Date of Patent: Jun. 23, 1987

[54] FOLDING UMBRELLA

[76] Inventor: Joseph DeMarco, 60 Seaman Ave., New York, N.Y. 10034

[21] Appl. No.: 800,693

[22] Filed: Nov. 22, 1985

[51] Int. Cl.[4] ..... A45B 19/06; A45B 23/00

[52] U.S. Cl. ..... 135/26; 135/20 M

[58] Field of Search ..... 135/25 R, 25 A, 20 M, 135/26, 27, 28, 29, 31

[56] References Cited

U.S. PATENT DOCUMENTS

| | | | |
|---|---|---|---|
| 832,355 | 10/1906 | Zuber | 135/26 |
| 1,161,139 | 11/1915 | Larsson | 135/27 |
| 2,194,389 | 3/1940 | Haupt | 135/31 |
| 3,732,882 | 5/1973 | Kida et al. | 135/25 R |
| 3,846,213 | 11/1974 | Thiemann | 135/31 X |

FOREIGN PATENT DOCUMENTS

| | | | |
|---|---|---|---|
| 390403 | 6/1922 | Fed. Rep. of Germany | 135/27 |
| 2226719 | 6/1972 | Fed. Rep. of Germany | 135/25 |
| 2300153 | 1/1973 | Fed. Rep. of Germany | 135/27 |
| 2707367 | 2/1977 | Fed. Rep. of Germany | 135/20 M |

*Primary Examiner*—Robert A. Hafer
*Assistant Examiner*—D. Neal Muir
*Attorney, Agent, or Firm*—Bauer & Amer

[57] ABSTRACT

A-folding umbrella in which articulatingly connected inner and outer rib members are supported by a single slidably disposed strut providing a large diameter in use, and a substantially reduced size when closed. The paired rib members are covered on their exterior by a fabric and are foldable against the rod so as to be all parallel to the rod.

3 Claims, 5 Drawing Figures

FOLDING UMBRELLA

BACKGROUND OF THE INVENTION

The present invention relates to folding umbrellas and in particular to the construction of a folding umbrella having a large diameter in use, suitable for the beach or for rain.

Large, folding umbrellas, intending to shade the sun such as beach umbrellas, picnic umbrellas and the like are quite common and while required to be large in radius have presented a problem during storage because of their size in use. Additionally, conventional, large, folding umbrellas have a complex rib and bracing structure in order to maintain the relatively heavy canvas or plastic fabric cover in taut extended position when shading the sun or acting as a barrier against foul weather.

Conventionally folding umbrellas comprise a fabric cover disposed over a plurality of ribs hinged at one end to a central rod extending spoke-like outwardly from the rod. Each rib is extended and held in open condition by an articulating triangular bracing arrangement comprising a strut secured at one end to a slide riding on the rod and hinged at its other end to the rib medial of its ends. It should be thus apparent that the length of the rib is in direct proportion to the radius of the umbrella and consequently a large diameter umbrella requires long ribs.

As the ribs are increased in length, they must be made of stronger and of heavier material so as to be able to carry the correspondingly enlarged fabric cover. As a result, the ribs must be provided with a stronger and more complex bracing system, including additional struts and additional articulation points.

In my earlier U.S. Pat. Nos. 4,007,753 and 4,350,175 sectional, fold-over ribs were employed as are used in standard umbrellas. I have found that such ribs are not useful when large diameter umbrellas are required.

It is the object of the present invention to provide a folding umbrella, of large diameter, which overcomes the disadvantages and inconveniences of the prior art.

It is a further object to provide an umbrella of the folding type which is light in weight and simpler in construction than those heretofor known.

It is a further object of the present invention to provide an umbrella construction having an improved and simplified rib and bracing arrangement.

These objects as well as others together with the numerous advantages will be apparent from the following disclosure of the invention.

SUMMARY OF THE INVENTION

The improved folding umbrella of the present invention is developed from the concept that the entire length of the rib supporting the fabric cover does not need to be a single unbroken member of a length as long as the diameter of the open umbrella nor if a sectioned rib is used, do the sections need to be hinged directly end to end. According to the present invention, a two part rib can be used, by providing a bracing or strut arrangement which in combination with the rib parts, produces two supporting triangles which hold the ribs stably and rigidly in extended position and which simultaneously permits folding of the rib parts into parallel contact with the central rod.

Thus, the ribs do not have to be made of a singular heavy material, or have any particularly strong configuration; nor does the strut arrangement have to be complicated or complex in articulation. The umbrella of the present invention is thus simpler, cheaper, lighter in weight and easier to use than those heretofore known.

In particular, the umbrella of the present invention comprises a folding umbrella comprising a central rod, a plurality of circumferentially spaced rib sets, each comprising a pair of articulatingly connected members and a single supporting strut articulatingly connected to both rib members as well as to the central rod and having a fabric cover that is disposed over the ribs. Each rib arrangement comprises an inner rib member and an outer rib member in the same vertical plane. The inner rib member is hinged at one end to the upper end of the central rod and at its other end to the outer rib member, medial of the ends of the outer rib member. The inner end of the outer rib member is hinged to a slide member disposed about the strut for movement therealong, and the strut is pivoted at its outer end to the inner rib and at its inner end to a slide hub on the central rod. The strut forms with the rods a pair of variable articulated triangles permitting the strut and rib members to be supported in extended position and to fold against the central rod parallel with each other.

The arrangement is such that a fabric cover can be stretched completely over and across the ribs from the central rod to the outer most tip of the outer rib member, thereby providing a full and complete integral cover suitable in the formation of a rain umbrella.

Full details of the present invention are set forth in the following description and illustrated in the accompanying drawings.

DESCRIPTION OF THE INVENTION

Figure 3:
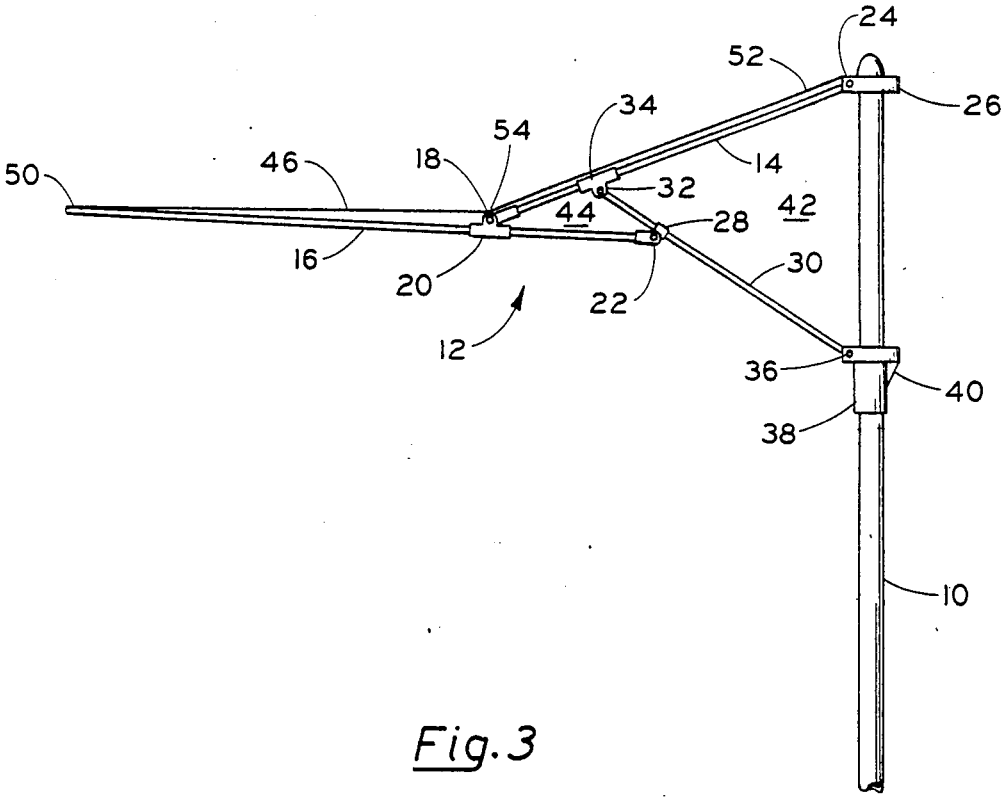
FIG. 3 is a radial section of the umbrella of FIG. 1 showing the ribs and bracing arrangement fully deployed.
Figure 4:
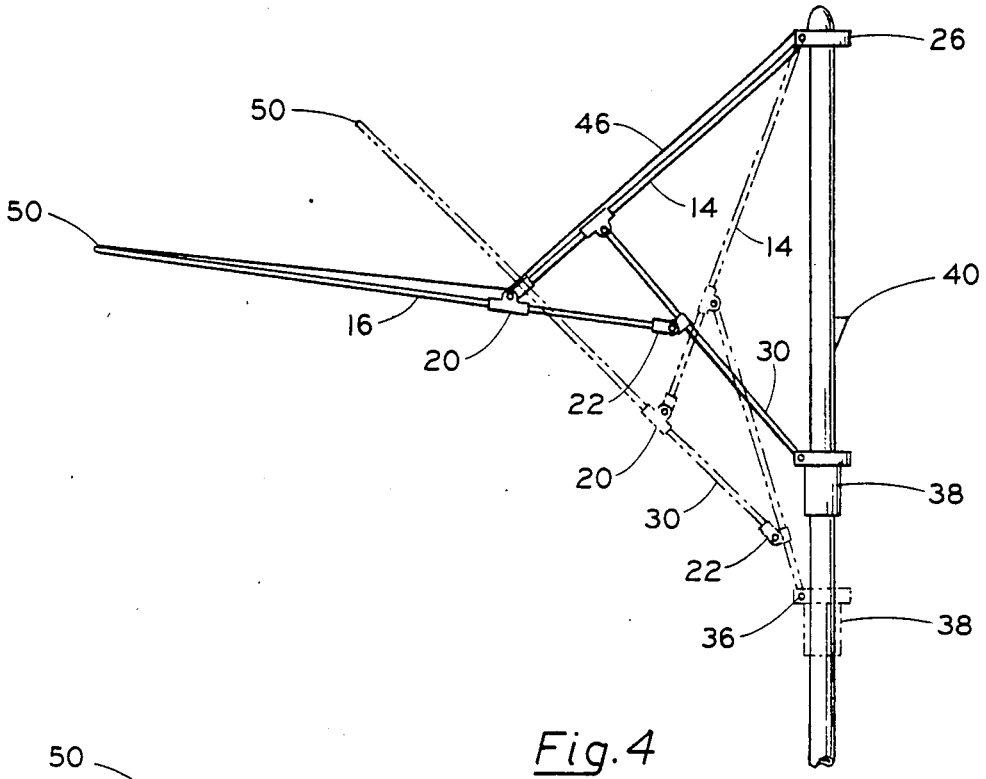
FIG. 4 is a view similar to FIG. 3 showing successive intermediate positions (full lines and phantom lines respectively) of the ribs and bracing arrangement in the act of being collapsed.

Referring to the drawings and particularly FIG. 3, the umbrella is formed with a central rod 10 about which is circumferentially disposed and spaced from each other, a plurality of rib sets individually and collectively designated 12 (FIG. 3). Each rib set 12 comprises a radially inner rib member 14 and an outer rib member 16. The inner rib 14 is articulatingly connected at its outer end 18, to pivot about an axis formed on a T-shaped hinge bracket 20 fixedly secured to the outer rib 16 medial of its ends (preferably about one third of the distance from its inner end 22), so that a minor portion of the inner and outer ribs 14 and 16 overlap each other, when fully extended.

The inner end 24 of each of the inner rib members 14 are hinged to a common hub 26 fixed at the top end of the rod 10. The inner end 22 of the outer rib member 16 is hinged to a slide 28 adapted to freely move along a strut 30 which is itself pivotally connected at its outer end 32 to a T-shaped hinge 34 secured fixedly to the rib member 14 medial of its ends (about one third the distance from the outer end 18 of the rib member 14). The inner end 36 of the strut 30 is pivotally connected to the flange of a slidable hub i.e. runner 38 mounted about the central rod 10, so as to be easily moveable up and down along the rod. A depressible latch 40 of conventional construction is located on the rod 10 and is adapted to engage below the flange of the runner 38, thus holding the slide in its uppermost position, while depression of the latch 40 allows the runner 38 to move downwardly.

Figure 1:
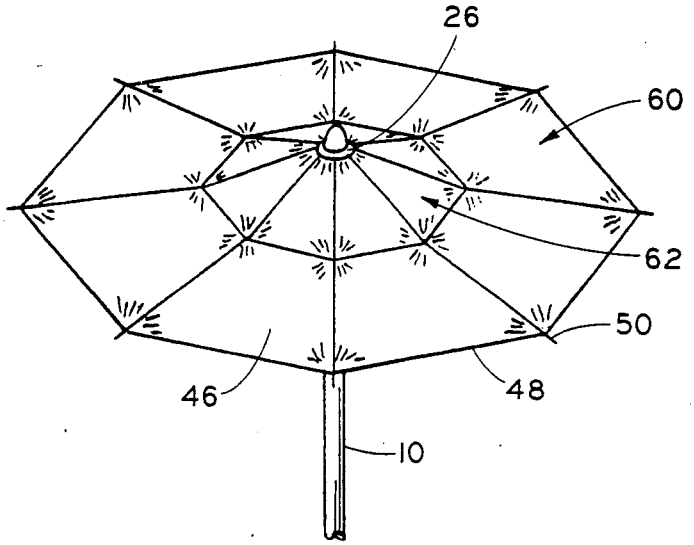
FIG. 1 is a top perspective view of the umbrella, embodying the present invention, fully deployed.

It will be observed that the single strut 30 forms with the rib members 14 and 16 a pair of variable shaped triangles 42 and 44 respectively. The triangles 42 and 44 change in shape as the umbrella is opened and closed; i.e., the rib structure extended outwardly from the central rod or collapsed adjacent thereto. This variation occurs as a result of the simultaneous movement of slide 28 and runner 38 along the strut 30 and the central rod 10 respectively. When the umbrella is fully opened as seen in FIGS. 1 and 3 and the outer rib member 16 extends substantially perpendicularly to the central rod while the inner rib member 14 extends at an acute angle from the rod, depending from the fixed upper hub 26. The strut 30 extends upwardly from the slidable runner 38, which has been raised to its uppermost extent, so that the strut 30 supports the extending ribs 14 and 16. In the collapsed position, FIG. 5, both the inner and outer rib members 14 and 16 extend substantially parallel to the axis of the rod 10, overlying the strut 30, which is also parallel to the rod 10. That is, both ribs 14 and 16 and the strut 30 collapse on each other substantially parallel to each other and the rod, thereby reducing the overall rib length by approximately half.

The fabric cover 46 of conventional material and form is spread over all of the ribs and is fixed at its outer perimeter 48 to the ends of each of the outer rib members 16 by conventional retaining tips 50, and at its inner perimeter 52, to the fixed central hub 26, as by sewing or the use of conventional clip means. The fabric 46 is also fastened at approximately its radial center 54 by the use of eyelets, loops, or the like, sewn or attached to its lower surface to the hinge member 20 by which the inner and outer rib members 14 and 16 are connected.

Figure 2:
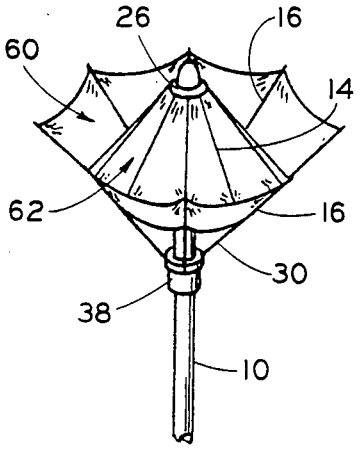
FIG. 2 is a similar view of the umbrella, shown in FIG. 1, partially folded.
Figure 5:
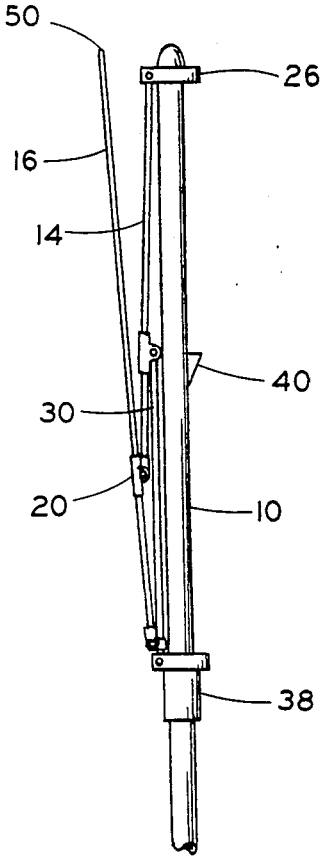
FIG. 5 is a view showing the ribs and bracing arrangement fully collapsed.

The outer perimeter 48 of the fabric 46 is cut and sewn to provide sufficient radial tension between the tip 50 and the fixed hub 26, taking into account that the fabric 46 is attached at its center 54 to the hinge 20. In this manner, the outer band of fabric 60, i.e., between the hinge 20 and the tips 50 and the inner band of the fabric 62, i.e., between the hinge 20 and the hub 26 are always in stretched and taut condition as seen in FIG. 2. While the fabric remains tensioned along the length of the rib members, the fabric folds inwardly and is hidden within the folded umbrella between the parallel folded rod members as seen in FIG. 5. That is, the fabric 46 which has been omitted from FIG. 5 occupies a position within the V-shape between the ribs 14 and 16.

The effective height of the umbrella i.e., the length in collapsed condition is defined by the rib member 16 but the effective diameter of the umbrella is defined by the overall length of both rib members 14 and 16.

In accordance with the present invention, a large sized umbrella is formed consisting of the radial entent of the outer rib member from its hinge 20 to its tip 50 and the effective radial extent of the inner rib member 14. When the umbrella is closed, the effective length is reduced substantially in size to a length which is the length only of the outer rib members, plus the slide 48. Because of this, it has been found in practice that there is no need for spring urgency in order to have the necessary mechanical advantage that this provides to open and close this relatively large umbrella.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A folding rain umbrella comprising a central vertical rod, a plurality of circumferentially spaced articulated rib sets, each having an inner rib member and an outer rib member adapted to extend in combination outwardly from said central rod equal to the intended radius of the umbrella, a fabric cover of a size coextensive with and disposed over said rib members, and a strut for extending said rib members outwardly with respect to said central rod to deploy said cover and for folding said rib members and cover toward said central rod, each of said rib sets having an inner rib member and an outer rib member arranged to extend radially from said rod in a radial plane, the inner rib member hinged at its inner end to the upper end of said central rod and hinged at its outer end to the outer rib member medial of the ends of the outer rib member, the outer rib member hinged at its inner end to a slide member disposed about said strut for movement therealong, said strut being hinged at its outer end to said inner rib member medial of the ends of the inner rib member and hinged at its inner end to a runner disposed about said rod, said strut forming with said inner and outer rib members a pair of supporting triangles, the upward movement of said runner causing said strut to extend said inner and outer rib members outwardly from the central rod extending said triangles and opening said cover to the fullest size thereoff corresponding to the intended diameter of the umbrella, and the downward movement of said runner causing said triangles to collapse and said inner and outer ribs to fold against said central rod substantially parallel therewith simultaneously with causing a folding in of said cover between said inner and outer rib members.

2. A folding umbrella as claimed in claim 1, wherein said cover is attached to its outer periphery to the outer ends of said outer rib members and at its center to said rod, said cover being attached medially between said outer periphery and said center to said hinge connecting said inner and outer ribs, whereby said cover folds during the closing of said umbrella in the area of said hinge between said inner and outer rib members.

3. The folding umbrella according to claim 2 wherein said covering is secured to said rib members and central rod so as to be taut and under tension in the extended and folded condition.

* * * * *